United States Patent [19]

Sigworth, Jr.

[11] Patent Number: 4,496,001

[45] Date of Patent: Jan. 29, 1985

[54] VACUUM SYSTEM FOR REDUCING HEAT LOSS

[75] Inventor: Harrison W. Sigworth, Jr., Orinda, Calif.

[73] Assignee: Chevron Research Company, San Francisco, Calif.

[21] Appl. No.: 431,417

[22] Filed: Sep. 30, 1982

[51] Int. Cl.[3] ..... E21B 36/00; E21B 43/24

[52] U.S. Cl. ..... 166/387; 166/57; 166/53; 166/303

[58] Field of Search ..... 166/57, 53, 303, 302, 166/369, 371, 179, 387, 53, 381, 380

[56] References Cited

U.S. PATENT DOCUMENTS

| | | | |
|---|---|---|---|
| 3,142,336 | 7/1964 | Doscher | 166/57 X |
| 3,234,879 | 2/1966 | Brown | 166/303 X |
| 3,352,359 | 11/1967 | Sutliff et al. | 166/57 X |
| 3,397,745 | 8/1968 | Owens et al. | 166/57 |
| 3,451,479 | 6/1969 | Parker | 166/57 X |
| 3,608,640 | 9/1971 | Willhite et al. | 166/57 X |
| 3,666,013 | 5/1972 | Saadeh | 166/57 X |
| 3,680,631 | 8/1972 | Allen et al. | 166/57 |
| 3,700,034 | 10/1972 | Hutchison | 166/312 |
| 3,811,499 | 5/1974 | Hutchison | 166/67 |
| 3,829,134 | 8/1974 | Hutchison | 285/14 |
| 3,840,072 | 10/1974 | Hutchison | 166/86 |
| 3,961,667 | 6/1976 | Mitchell | 166/187 |
| 4,088,191 | 5/1978 | Hutchison | 166/233 |
| 4,345,647 | 8/1982 | Carmichael | 166/66 |
| 4,369,839 | 1/1983 | Freeman et al. | 166/53 |
| 4,403,656 | 9/1983 | Ploeg et al. | 166/303 X |

*Primary Examiner*—Stephen J. Novosad

*Attorney, Agent, or Firm*—S. R. LaPaglia; E. J. Keeling; P. L. McGarrigle

[57] ABSTRACT

A vacuum system is disclosed for reducing heat loss within the annular chamber of a steam injection well. The apparatus includes elements for drawing vapor within the annular chamber outside the well, elements for condensing the vapor and elements for discharging the fluid. In addition, the apparatus incorporates elements to isolate and bypass the vacuum and condensing means in the event of high-steam leakage that may damage any components thereof.

29 Claims, 1 Drawing Figure

VACUUM SYSTEM FOR REDUCING HEAT LOSS

INTRODUCTION

The present invention relates to a vacuum system for reducing heat loss from the well annulus of a steam injection well wherein a system is utilized to draw vapor from within the annular chamber formed in a well between the well casing and a steam injection tubing above a thermal packer, condense the vapor and remove it as a liquid.

BACKGROUND OF THE INVENTION

In a typical steam injection well, steam is injected through a relatively small diameter uninsulated tubing string. This steam injection tubing string is run inside the well casing and forms an annular chamber therewith. Near the bottom of the steam injection tubing string is a thermal packer that seals the space between the tubing string and the well casing. This seal insures that steam is injected into the producing formation. The annular chamber is vented to the air to relieve any pressure build-up from steam leakage passed the packer or from any other sources of leakage.

Heat losses from steam injection wells result in significant added fuel costs. Typical heat losses from steam injection tubing are 400 to 600 BTU/hr. per foot of tubing. Commercially available insulated tubing can be used to reduce the heat losses to approximately 75 to 150 BTU/hr. per foot of tubing, however, insulated tubing is relatively expensive.

Filling the annular chamber with insulation can provide insulating value near that of commercially available insulated tubings, but a major cost reduction. To be effective, insulation must be kept dry. When insulation becomes wet, it loses much of its value as an insulator and may also lose its structural integrity. It is extremely difficult to maintain a dry state within a steam injection well because of steam leakage passed the thermal packer; condensation of the steam on surfaces kept cool by insulation wets the insulation. Also, ground water penetration into the well casing can and often does, occur. There is need, therefore, for a practical and efficient method for maintaining the structural integrity and insulating value of insulation used in a steam injection well.

SUMMARY OF THE INVENTION

The present invention provides a practical method of establishing and maintaining a vacuum to preserve or dry insulation. If a partial vacuum is maintained such that condensation of water cannot occur on the coldest surfaces of the annular chamber, the water can migrate out of the well as a vapor and be condensed and disposed of outside the well.

The present invention is directed to a vacuum system for reducing heat loss. It is utilized to draw the vapor from the annular chamber and condense and dispose of the vapor outside the well. The apparatus includes elements for drawing the vapor outside the annular chamber, elements for condensing the vapor into a fluid and elements for discharging the fluid. Elements are incorporated to protect the vacuum and condensing components by isolating and bypassing them in the event of excessive steam leakage.

PRINCIPAL OBJECT OF THE INVENTION

The particular object of the present invention is to remove and discharge vapor from the annular chamber of a steam injection well. This would serve to effectively reduce heat loss from the steam injection well by allowing the introduction of insulation into the annular chamber and maintaining the insulation in a dry state. Also, insulation that becomes wet may be dried by utilizing the vacuum system to remove and discharge fluid within the annular chamber.

Additional objects and advantages of the present invention will become apparent from a detailed reading of the specification and drawings which are incorporated herein and made a part of this invention.

DESCRIPTION OF THE PREFERRED EMBODIMENT

Figure 1:
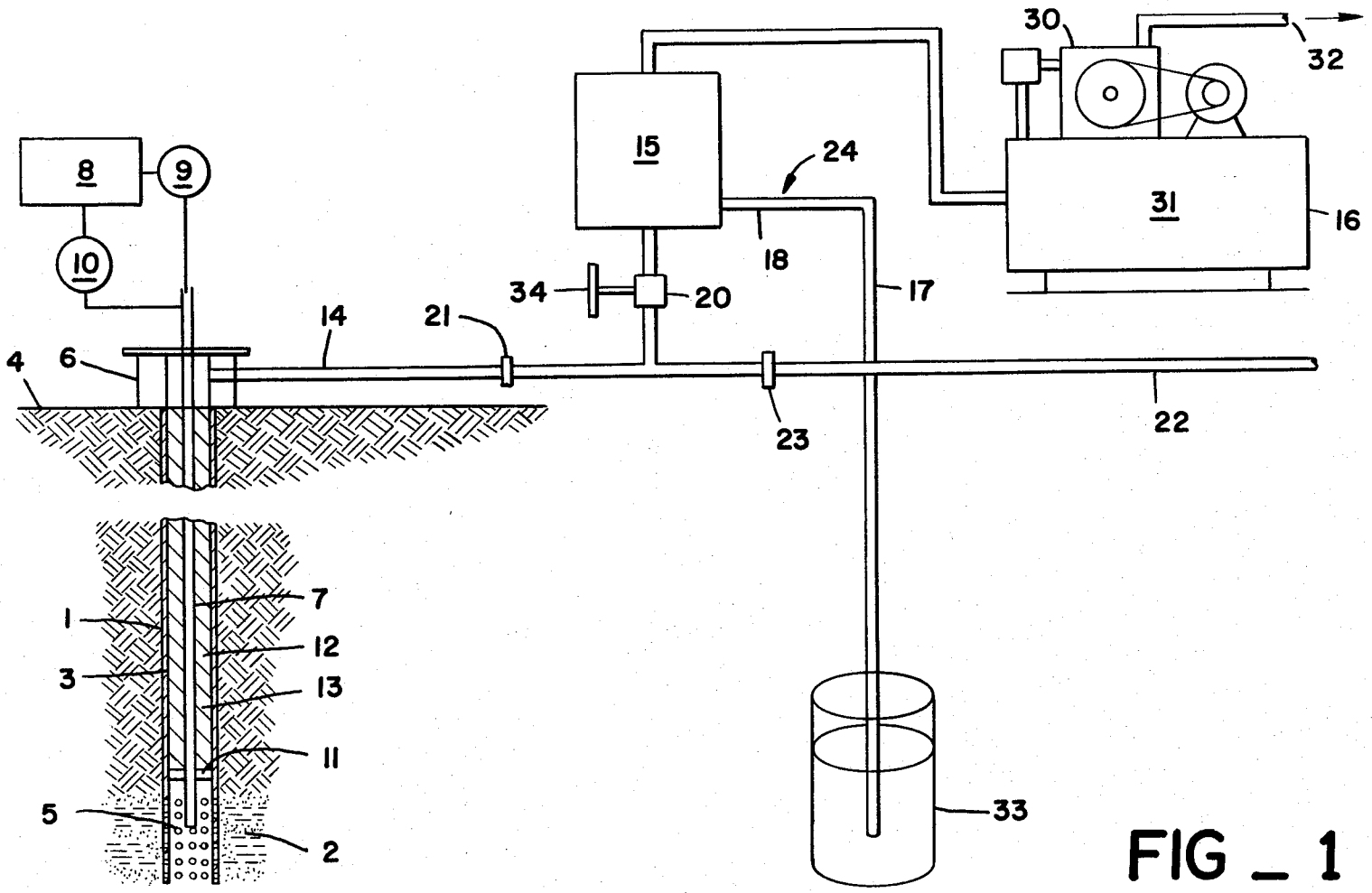
FIG. 1 is an elevation view, partially in section, illustrating the preferred embodiment of the invention.

FIG. 1 shows an elevation view, partially in section, of a well 1 penetrating an oil-bearing formation 2. A well casing 3 extends from the earth's surface 4 to the oil-bearing formation 2. A portion of the well casing 3 adjacent the oil-bearing formation 2 may contain producting liner 5, including perforations or slots, to permit oil from the oil-bearing formation 2 to flow into the well 1. A wellhead 6 or other suitable sealing means forms an air-tight seal at the upper portion of the well casing 3.

A steam injection tubing 7, sealed in air-tight relationship at the wellhead 6, extends through the wellhead 6 and laterally along the well casing 3, terminating adjacent the oil-bearing formation 2. At the earth's surface 3 a steam generator and injector control 8 connected through a pair of valves 9 and 10 to the steam injection tubing 7 generate and control the injection of steam through the steam injection tubing 7. Thermal packer 11, located above the oil-bearing formation 2, closes off the space between the steam injection tubing 7 and well casing 3, thereby forming a substantially annular chamber 12 between the wellhead 6 and said thermal packer 11. The substantially annular chamber may be partially or totally filled with insulating material 13.

Vacuum inlet tube 14 connected to the well casing 3 and communicating with the substantially annular chamber 12 extends through a condensing means 15 to a vacuum producing means 16, including a vacuum pump 30, vacuum pump tank 31 and vacuum outlet tube 32. A vacuum of twenty-eight inches mercury is preferred, the minimum and maximum values being twenty-five inches mercury and twenty-nine inches mercury respectively. The condensing means 15 contains a condensing drain outlet 18 for discharging the condensed vapor therethrough. A second vacuum producing means 24, including a drainage drop tube 17 connected to the condensing drain outlet 18 and extending to and submerged in a partially filled drain tank 33 below, procedures a second partial vacuum at the condensing drain outlet 18 having a pressure at most equal to the pressure of the first partial vacuum connected to the condensing drain outlet 18.

A shutoff means 34 closes off the vacuum inlet tube 14 upstream of the vacuum producing means 16 and condensing means 15 in the event pressure in the vacuum inlet tube 14 exceed a predetermined value. The predetermined value ranges from a minimum pressure of five psig to a maximum pressure of thirty psig; fifteen psig being optimum. The shutoff means 34 consists of an emergency automatic shutoff control valve 20 and a critical flow orifice 21, both in the vacuum inlet tube 14 and upstream of the condensing means 15 and the vacuum producing means 16. The critical flow orifice 21 is located upstream of the emergency automatic shutoff control valve 20.

Emergency pressure relief pipe 22 is connected to and communicates with the vacuum inlet tube 14 upstream of the emergency automatic control valve 20. Emergency pressure relief pipe 22 is sealed with a rupture disk 23 to maintain the partial vacuum within the substantially annular chamber 12 during normal operation. Ruptured disk 23 bursts when pressure in the emergency pressure relief pipe 22 exceeds a second predetermined value. The second predetermined value is equal to or slightly greater than the predetermined pressure value used to activate the shutoff means.

The vacuum system reduces heat loss from a steam injection well. Vapor drawn from within the annular chamber is condensed and discharged outside the well. Condensation within the annular chamber is virtually eliminated. This by itself will reduce heat loss, but the ability to introduce and maintain insulation within the annular chamber significantly increases the well's efficiency.

The following vacuum system for reducing heat loss from steam injection tubing has been implemented at well 7-2W, Section 27, Kern Front. Demonstrations have clearly shown the feasibility, economy and successful operation of the vacuum system.

In accordance with the present invention, a well was drilled into a subsurface formation and casing was placed into the well to prepare the formation for production. The casing may be perforated or provided with slotted liners in those areas of the subsurface formation where production is expected. The formations are treated in many and several different manners to prepare them for injection of hot fluids or steam.

A tubing string was passed down into the casing with its lower end aligned with the formation where the steam was to be injected. A thermal packer was placed above the formations to be treated to insure that the steam that was injected down the tubing string was retained in the area where the heavy gravity crude is located. The outside of the tubing string was anchored in the packer and the packer substantially prevented the injected hot fluids from flowing upwardly through the annular chamber between the thermal packer and wellhead.

The tubing string is usually centralized within the casing to prevent heat loss from the tubing string into the casing. The centralizers are usually constructed with a low heat conducting material to improve the efficiency of the system.

To prevent heat loss passed the thermal packer and from the steam injected tubing string, the annular chamber is filled with insulation. This insulation must be kept dry or it loses much of its value as an insulator.

By establishing a partial vacuum within the annular chamber such that condensation cannot occur on the coldest surfaces in the annular chamber, the water may pass as a vapor out of the well and be condensed and discharged outside the well. Vacuum drying of this type has been applied to food processing and packaging operations, but its application to well insulation has not yet been apparent. The primary components include a vacuum pump, vacuum pump tank and vacuum exhaust, a condensing means, a condensing drainage means and shutoff means to isolate the vacuum and condensing components in the event of high-steam leakage rates; as may occur with a steam injection tubular or thermal packer failure. The vacuum pump serves to establish and maintain a vacuum in the annular chamber. A condensing means located upstream of the vacuum pump minimizes pump on time by removing vapor as a liquid. The liquid may then be removed from the condensing means by creating a second partial vacuum at a condensing drain outlet at least equal to the vacuum passing through the condensing means. One method of creating this second partial vacuum includes a drainage drop tube connected to the condensing drain outlet and extending to and submerged in a partially full drain tank below. The drain tank must be a vertical distance below the condensing system drain outlet at least equal to that of the vacuum passing through the condensing means. Another method of achieving the required vacuum at the condensing system drain outlet would be to attach a second vacuum pump to the condensing system drain outlet or anywhere along the drainage drop tube.

The shutoff means protects the vacuum and condensing components by closing a control valve in response to excessive pressure upstream of a critical flow orifice within the vacuum inlet tube. A rupture disc prevents backflow into the vacuum inlet tube and annular chamber by bursting under excessive pressure and venting the system.

While a certain preferred embodiment has been specifically disclosed, it should be understood that the invention is not limited thereto as many variations will be readily apparent to those skilled in the art and the invention is to be given its broadest possible interpretation within the terms of the following claims.

What is claimed is:

1. A method for reducing heat loss from steam injection tubing located in a well casing penetrating through the earth to an oil producing formation for producing oil therefrom comprising the steps of:

(a) sealing the upper portion of said well casing to form an air-tight chamber therein;

(b) extending steam injection tubing from the earth's surface, through the sealed upper portion of said well casing in air-tight relationship therewith and terminating adjacent the lower portion of the well casing suitable for injecting steam into the oil producing formation;

(c) packing off the space between said steam injection tubing and the well casing adjacent the lower portion of the tubing string and above the oil producing formation to form a substantially annular chamber between the upper portion of said well casing and the packed off portion thereof;

(d) maintaining a partial vacuum within said annular chamber said minimum and maximum vacuum within said annular chamber being 25" mercury and 29" mercury, respectively, such that condensation of water vapor cannot occur on the surfaces forming said annular chamber;

(e) filling at least a portion of said annular chamber with loose fill insulating material; and (f) isolating the vacuum producing means so pressure in excess of a predetermined value does not damage any components thereof.

2. The method for reducing heat loss from steam injection tubing of claim 1 further characterized by condensing the vapor with condensing means and discharging the fluid through a condensing drain outlet prior to the vapor reaching the vacuum producing means.

3. The method for reducing heat loss from steam injection tubing of claim 2 further characterized by isolating the vacuum producing means and condensing means so pressure in excess of the predetermined value does not damage any components of the vacuum producing means or condensing means.

4. The method for reducing heat loss from steam injection tubing of claims 1 or 3 such that the minimum and maximum predetermined pressure values are 5 psig and 30 psig, respectively.

5. A system for reducing heat loss from steam injection tubing located in a well comprising:

(a) a tubular well casing positioned in a well and extending from the earth's surface to an oil producing formation;

(b) a sealing means at the upper portion of said well casing forming an air-tight seal thereon, the lower portion of said casing adapted to allow oil to be produced up said well from said producing formation;

(c) steam injection tubing extending through said sealing means into said well casing and terminating adjacent the lower portion thereof, said tubing string providing a flow path for steam from the earth's surface to the producing formation;

(d) a thermal packer, adjacent the lower portion of the well, and closing off the space between said tubing and said well casing above said producing formation, forming a substantially annular chamber between said sealing means and said thermal packer;

(e) solid loose fill insulating material contained in at least a portion of said annular chamber;

(f) vacuum producing means, including a vacuum pump communicating with a vacuum pump tank, said vacuum pump having a vacuum outlet tube, said vacuum pump tank having a vacuum inlet tube, said inlet connected to the well casing and communicating with the annular chamber to impose a partial vacuum therein to draw vapor from within the annular chamber toward the outlet; and (g) a shutoff means operable in response to a predeterminable pressure value for closing off said vacuum inlet tube upstream of said vacuum producing means.

6. A system for reducing heat loss from steam injection tubing located in a well comprising:

(a) a tubular well casing positioned in a well and extending from the earth's surface to an oil producing formation;

(b) a sealing means at the upper portion of said well casing forming an air-tight seal thereon, the lower portion of said casing adapted to allow oil to be produced up said well from said producing formation;

(c) steam injection tubing extending through said sealing means into said well casing and terminating adjacent the lower portion thereof, said tubing string providing a flow path for steam from the earth's surface to the producing formation;

(d) a thermal packer, adjacent the lower portion of the well, and closing off the space between said tubing and said well casing above said producing formation, forming a substantially annular chamber between said sealing means and said thermal packer;

(e) vacuum producing means, including a vacuum pump communicating with a vacuum pump tank, said vacuum pump having a vacuum outlet tube, said vacuum pump tank having a vacuum inlet tube, said inlet connected to the well casing and communicating with the annular chamber to impose a partial vacuum therein to draw vapor from within the annular chamber toward the outlet; and (f) a shutoff means to close off the vacuum inlet tube upstream of the vacuum producing means in the event pressure in the inlet tube exceeds a predetermined value.

7. The system for reducing heat loss of claim 6 further characterized in that the annular chamber contains loose fill insulating material.

8. The system of claim 7 further characterized in that said shutoff means comprises an emergency automatic shutoff control valve and a critical flow orifice both in said inlet tube and upstream of the vacuum producing means, said critical flow orifice located upstream of said shutoff control valve to activate said valve if the pressure at the critical flow orifice exceeds the predetermined value.

9. The system of claim 8 further characterized in that said shutoff means comprises an emergency pressure relief pipe connected to and communicating with the vacuum inlet tube and upstream of the emergency automatic shutoff control valve, said emergency pressure relief pipe sealed with a rupture disk, therefore maintaining the vacuum withiin the annular chamber during normal operation, said rupture disk to burst when pressure in the emergency pressure relief pipe exceeds a second predetermined value.

10. The system of claim 7 further characterized in that said shutoff means comprises an emergency pressure relief pipe connected to and communicating with the vacuum inlet tube and upstream of the emergency automatic shutoff control valve, said emergency pressure relief pipe sealed with a rupture disk, therefore maintaining the vacuum within the annular chamber during normal operation, said rupture disk to burst when pressure in the emergency pressure relief pipe exceeds a second predetermined value.

11. The system of claim 6 further characterized in that said shutoff means comprises an emergency automatic shutoff control valve and a critical flow orifice both in said inlet tube and upstream of the vacuum producing means, said critical flow orifice located upstream of said shutoff control valve to activate said valve if the pressure at the critical flow orifice exceeds the predetermined value.

12. The system of claim 11 further characterized in that said shutoff means comprises an emergency pressure relief pipe connected to and communicating with the vacuum inlet tube and upstream of the emergency automatic shutoff control valve, said emergency pressure relief pipe sealed with a rupture disk, therefore maintaining the vacuum within the annular chamber during normal operation, said rupture disk to burst when pressure in the emergency pressure relief pipe exceeds a second predetermined value.

13. The system of claim 6 further characterized in that said shutoff means comprises an emergency pressure relief pipe connected to and communicating with the vacuum inlet tube and upstream of the emergency automatic shutoff control valve, said emergency pressure relief pipe sealed with a rupture disk, therefore maintaining the vacuum within the annular chamber during normal operation, said rupture disk to burst when pressure in the emergency pressure relief pipe exceeds a second predetermined value.

14. A system for reducing heat loss from steam injection tubing located in a well comprising:

(a) a tubular well casing positioned in a well and extending from the earth's surface to an oil producing formation;

(b) a sealing means at the upper portion of said well casing forming an air-tight seal thereon, the lower portion of said casing adapted to allow oil to be produced up said well from said producing formation;

(c) steam injection tubing extending through said sealing means into said well casing and terminating adjacent the lower portion thereof, said tubing string providing a flow path for steam from the earth's surface to the producing formation;

(d) a thermal packer, adjacent the lower portion of the well, and closing off the space between said tubing and said well casing above said producing formation, forming a substantially annular chamber between said sealing means and said thermal packer;

(e) vacuum producing means, including a vacuum pump communicating with a vacuum pump tank, said vacuum pump having a vacuum outlet tube, said vacuum pump tank having a vacuum inlet tube, said inlet connected to the well casing and communicating with the annular chamber to impose a partial vacuum therein to draw vapor from within the annular chamber toward the outlet; and (f) a means for condensing the vapor drawn by the vacuum prior to the vapor reaching the vacuum producing means, a condensing drain outlet in said condensing means for discharging fluid therethrough, means for producing a second partial vacuum at the outlet having a pressure at most equal to the pressure of the first partial vacuum connected to said outlet.

15. The system for reducing heat loss of claim 14 further characterized in that the annular chamber contains loose fill insulating material.

16. The system for reducing heat loss of claim 15 further characterized in that said means producing the second partial vacuum includes a partially full drain tank, said drain tank positioned a predetermined vertical distance beneath the outlet in said condensing means and a drainage drop tube connecting with the condensing drain outlet and extending to and submerged in said drain tank.

17. The system for reducing heat loss of claim 16 further characterized by shutoff means to close off the vacuum inlet tube upstream of the vacuum producing means and condensing means in the event pressure in the inlet tube exceeds the predetermined value.

18. The system of claim 17 further characterized in that said shutoff means comprises an emergency automatic shutoff control valve and a critical flow orifice both in said inlet tube and upstream of the vacuum producing means and condensing means, said critical flow orifice located upstream of said shutoff control valve to activate said valve if the pressure at the critical flow orifice exceeds the predetermined value.

19. The system of claim 18 further characterized in that said shutoff means comprises an emergency pressure relief pipe connected to and communicating with the vacuum inlet tube and upstream of the emergency automatic shutoff control valve, said emergency pressure relief pipe sealed with a rupture disk, therefore maintaining the vacuum within the annular chamber during normal operation, said rupture disk to burst when pressure in the emergency pressure relief pipe exceeds the second predetermined value.

20. The system for reducing heat loss of claim 15 further characterized by shutoff means to close off the vacuum inlet tube upstream of the vacuum producing means and condensing means in the event pressure in the inlet tube exceeds the predetermined value.

21. The system of claim 20 further characterized in that said shutoff means comprises an emergency automatic shutoff control valve and a critical flow orifice both in said inlet tube and upstream of the vacuum producing means and condensing means, said critical flow orifice located upstream of said shutoff control valve to activate said valve if the pressure at the critical flow orifice exceeds the predetermined value.

22. The system of claim 21 further characterized in that said shutoff means comprises an emergency pressure relief pipe connected to and communicating with the vacuum inlet tube and upstream of the emergency automatic shutoff control valve, said emergency pressure relief pipe sealed with a rupture disk, therefore maintaining the vacuum within the annular chamber during normal operation, said rupture disk to burst when pressure in the emergency pressure relief pipe exceeds the second predetermined value.

23. The system for reducing heat loss of claim 14 further characterized in that said means producing the second partial vacuum includes a partially full drain tank, said drain tank positioned a predetermined vertical distance beneath the outlet in said condensing means and a drainage drop tube connecting with the condensing drain outlet and extending to and submerged in said drain tank.

24. The system for reducing heat loss of claim 23 further characterized by shutoff means to close off the vacuum inlet tube upstream of the vacuum producing means and condensing means in the event pressure in the inlet tube exceeds the predetermined value.

25. The system of claim 24 further characterized in that said shutoff means comprises an emergency automatic shutoff control valve and a critical flow orifice both in said inlet tube and upstream of the vacuum producing means and condensing means, said critical flow orifice located upstream of said shutoff control valve to activate said valve if the pressure at the critical flow orifice exceeds the predetermined value.

26. The system of claim 25 further characterized in that said shutoff means comprises an emergency pressure relief pipe connected to and communicating with the vacuum inlet tube and upstream of the emergency automatic shutoff control valve, said emergency pressure relief pipe sealed with a rupture disk, therefore maintaining the vacuum within the annular chamber during normal operation, said rupture disk to burst when pressure in the emergency pressure relief pipe exceeds the second predetermined value.

27. The system for reducing heat loss of claim 14 further characterized by shutoff means to close off the vacuum inlet tube upstream of the vacuum producing means and condensing means in the event pressure in the inlet tube exceeds the predetermined value.

28. The system of claim 27 further characterized in that said shutoff means comprises an emergency automatic shutoff control valve and a critical flow orifice both in said inlet tube and upstream of the vacuum producing means and condensing means, said critical flow orifice located upstream of said shutoff control valve to activate said valve if the pressure at the critical flow orifice exceeds the predetermined value.

29. The system of claim 28 further characterized in that said shutoff means comprises an emergency pressure relief pipe connected to and communicating with the vacuum inlet tube and upstream of the emergency automatic shutoff control valve, said emergency pressure relief pipe sealed with a rupture disk, therefore maintaining the vacuum within the annular chamber during normal operation, said rupture disk to burst when pressure in the emergency pressure relief pipe exceeds the second predetermined value.

* * * * *